US010590638B2

(12) United States Patent
Sinnett

(10) Patent No.: US 10,590,638 B2
(45) Date of Patent: Mar. 17, 2020

(54) TOILET PLUNGER

(71) Applicant: SYNECO, LLC, Greenville, SC (US)

(72) Inventor: Jay C Sinnett, Greenville, SC (US)

(73) Assignee: SYNECO, LLC, Greenville, SC (US)

( * ) Notice: Subject to any disclaimer, the term of this patent is extended or adjusted under 35 U.S.C. 154(b) by 0 days.

(21) Appl. No.: 16/055,885

(22) Filed: Aug. 6, 2018

(65) Prior Publication Data

US 2019/0085542 A1 Mar. 21, 2019

Related U.S. Application Data

(60) Provisional application No. 62/559,624, filed on Sep. 17, 2017.

(51) Int. Cl.
*E03C 1/308* (2006.01)

(52) U.S. Cl.
CPC ..... *E03C 1/308* (2013.01)

(58) Field of Classification Search
CPC ..... E03C 1/308
USPC ..... 4/255.11
See application file for complete search history.

(56) References Cited

U.S. PATENT DOCUMENTS

| | | | | |
|---|---|---|---|---|
| 2,203,185 A | | 6/1940 | Walus | |
| 3,336,604 A | | 8/1967 | Lacey | |
| 3,994,032 A | | 11/1976 | Spickofsky | |
| 4,745,641 A | | 5/1988 | Waxman | |
| 5,454,779 A | * | 10/1995 | Lurie | A61H 31/00 601/43 |
| 5,645,522 A | * | 7/1997 | Lurie | A61H 31/00 601/43 |
| 6,374,427 B1 | | 4/2002 | Tash | |
| D613,468 S | | 4/2010 | Kosasih | |
| 8,245,329 B2 | | 8/2012 | Stein | |
| 8,782,822 B1 | | 7/2014 | Vandenberg | |
| 10,287,763 B2 | * | 5/2019 | Wang | E03C 1/308 |
| 2014/0033419 A1 | | 2/2014 | Daciw | |
| 2014/0115768 A1 | | 5/2014 | Wang | |

FOREIGN PATENT DOCUMENTS

| | | |
|---|---|---|
| ES | 1 057 865 U | 6/2004 |
| WO | WO 01/06066 | 1/2001 |

OTHER PUBLICATIONS https./www.amazon.com/PlumbCraft-Powereful-Plunger-including-showers/dp/B00J418BBEG: Dec. 26, 2017: 12 pages.

* cited by examiner

*Primary Examiner* — Lori L Baker
(74) *Attorney, Agent, or Firm* — J. Bennett Mullinax, LLC

(57) ABSTRACT

A toilet plunger having a skirt and reinforced handle portion to prevent the collapse of the plunger and to facilitate a negative pressure being exerted against an obstruction in a toilet.

6 Claims, 7 Drawing Sheets

TOILET PLUNGER

RELATED APPLICATIONS

This application claims the benefit of U.S. Provisional Application Ser. No. 62/559,624 filed on 31 Aug. 2017 and which is incorporated herein by reference.

FIELD OF THE INVENTION

This invention is directed towards toilet plungers and more specifically relates to toilet plungers having improvements in form of the design utilizing a lower tapered thickness skirt, reinforced ridges on an interior portion of a bellow of the plunger, the upper surface of the bellow further interacting with a plurality of angled wall portions that provide a tapered reinforcement between a handle receiving area of the plunger and an exterior margin of the bellow portion of the plunger.

BACKGROUND OF THE INVENTION

There are a variety of toilet plungers that have been designed and, marketed. Designs ranges from a simple cup shaped plunger to more elaborate bellow plungers, the later being seen in U.S. Pat. No. 4,745,641 and which is incorporated herein by reference.

Other plunger designs can be seen such as the one depicted in US Publication No. 2014/0115768 and U.S. Pat. No. 8,782,822 and which are incorporated herein by reference. In the above referenced design, a smaller diameter flange member is positioned beneath a larger diameter cup portion of a plunger.

These and other prior art designs suffer from a variety of problems the first of which is that they are relatively inefficient, frequently requiring several cycles of use to clear a clog. Every time they are pushed or pulled without clearing the clog introduces the possibility of an unsanitary "splash back". The inefficiency of these former designs results from a poor seal between the plunger and the toilet and the attempt to clear the clog by vigorous pushing instead of by suction. Some other plunger designs will tend to collapse or fold toward one side, making the plunger inefficient and or being incapable of being safely operated. Other designs lack the rigidity needed to avoid a collapse when "pushed" with respect to the toilet.

Professional opinion holds that clogs are cleared more effectively with suction instead of pressure, but typical plunger designs are not designed to create suction effectively. Specifically, the neck (or flange) typically added to the cup design would be optimized for use in a pressure mode only and only if the receiving hole in the toilet is perfectly circular.

The present design incorporates the principle of a suction cup, with a "lip seal" that is optimized for creating suction, regardless of the geometry of the specific toilet it's being used on. The improvement in achievable suction is better than 60% over all other manually-operated plunger designs due to the better seal.

Accordingly, there remains room for improvement and variation within the art.

SUMMARY OF THE INVENTION

It is one aspect of at least one of the present embodiments to provide for a toilet plunger that facilitates use of a suction force as opposed to a pressure pushing force with respect to an obstruction within a toilet drain line. The use of "suction force" means that the user inserts the plunger in the toilet, aligns it with the exit hole, and slowly compresses the plunger until it is fully compressed. Then the user pulls sharply and vigorously, creating a substantial suction force on the clog.

It is a further aspect of at least one embodiment of the present invention to provide for a toilet plunger having reinforcement areas that make the plunger resistant to undesired collapsing.

It is yet a further aspect of at least one embodiment of the present invention, to provide for a toilet plunger which, following use, does not accumulate liquid within an interior cavity of the plunger. In particular, there is no failure mode in which the present plunger could semi-permanently adopt an alternative shape that traps liquid.

It is a further aspect of at least one embodiment of the present invention to provide for a toilet plunger comprising: a bottom skirt having a thickness at a outer circumferential edge less than a thickness of the skirt at an inner-circumferential edge, a lower surface of the bottom skirt being coplanar with a plane defined by a top surface of the third bellow;

a plurality of at least three bellows, a first bellow secured to an upper surface of the skirt a second bellow position above and attached to the first bellow possibly having a diameter less than a diameter of the first bellow, and a third bellow, positioned above and attached to the second bellow possibly having a diameter less than a diameter of the second bellow, an interior space defined by the first, second, and third bellows defining a volume;

The total height of the bellows is less than or equal to the diameter of the bellows at the base. This provides stability, preventing sideways collapse failures.

a handle securing region having a cylinder defining an inner cylinder surface having a plurality of threads adapted for receiving a handle and an outer cylinder wall;

a plurality of ribs arranged around a vertical wall and attached to an outer cylinder wall, each rib further defining a bottom wall supported on an upper surface of the bellow top wall, each rib further defining an edge wall that extends from a circumferential edge of the bellow top wall to an upper edge of cylinder.

It is a further aspect of at least, one embodiment of the present invention to provide for a toilet plunger comprising a set of support ribs having a thickness that may be tapered to decrease from a bottom of the rib to the top wall of rib.

It is a further aspect of at least one embodiment of the present invention to provide for a toilet plunger comprising a skirt wherein an upper surface of the skirt defines a plurality of stiffening ribs, each rib having an axis along its length that is tangential to the outer circumferential edge of the skirt.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
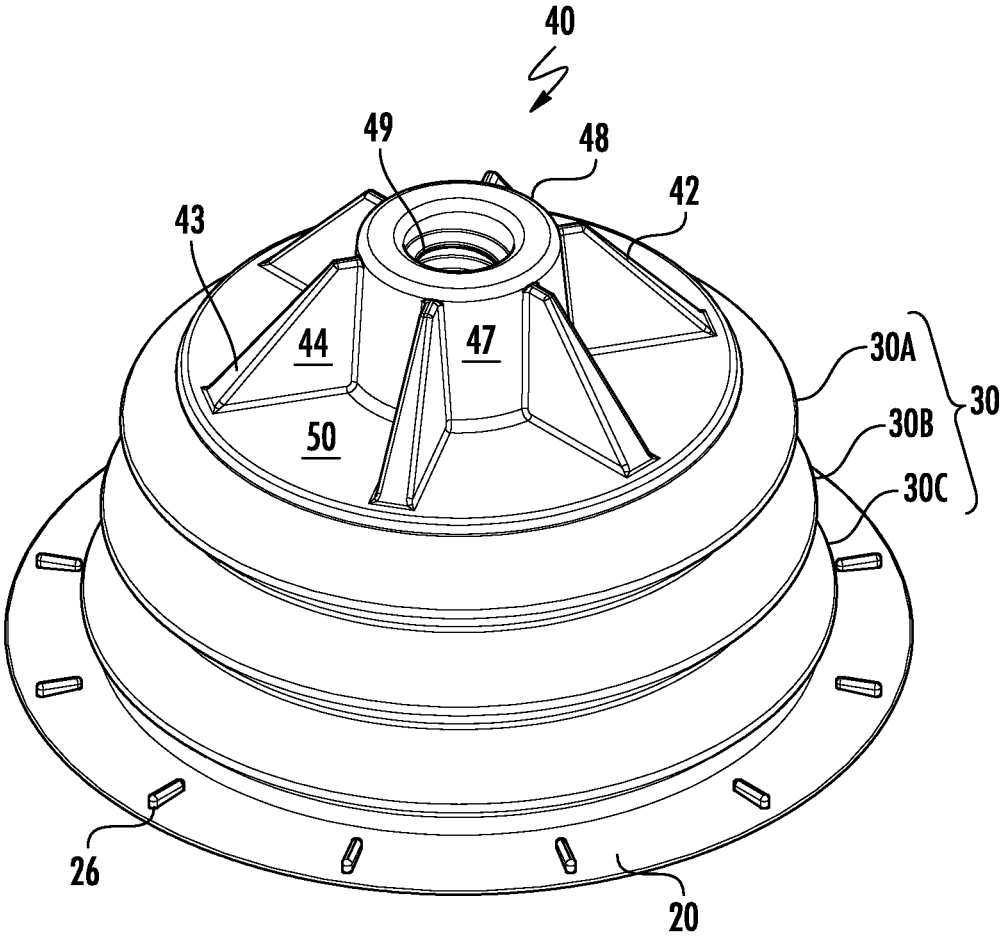
FIG. 1 is a perspective view of a toilet plunger. For clarification purposes, a typical threaded wooden or plastic handle is not illustrated.
Figure 5:
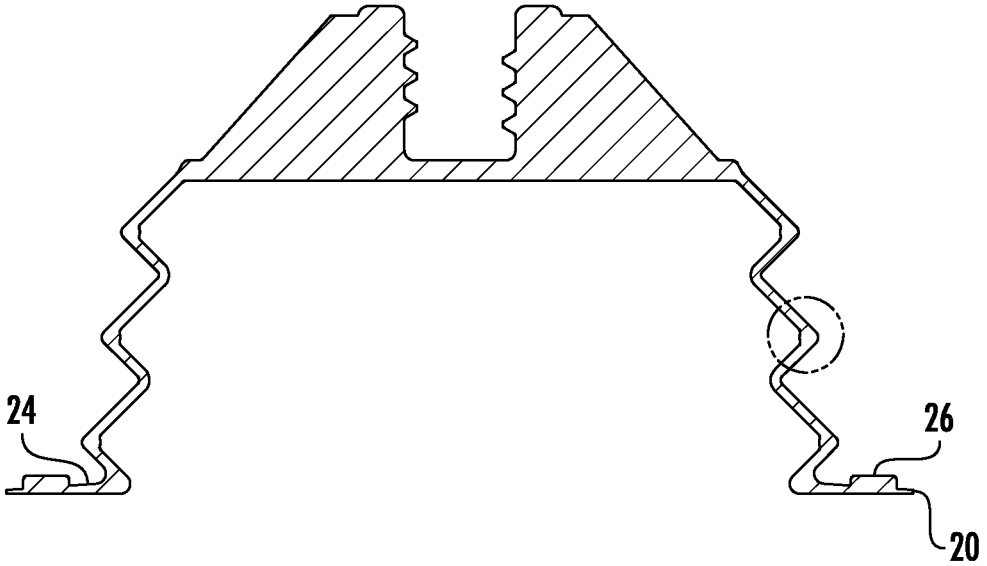
FIG. 5 is a cross section view taken along section line 5-5 of FIG. 4.

As set forth in FIG. 1, a toilet plunger is provided having a plurality of three bellow portions 30*a*, 30*b*, and 30*c* and collectively makes up the bellow 30. Attached is a bottom of bellow 30*c* is a skirt 20, an upper surface of flange 20 defining a plurality of rectangular ribs 26. As shown in FIG. 5, Skirt 20 has a greater thickness in region 24 which tapers to a reduced thickness near the edge 22. Ribs 26 are orientated such that an axis extending through a length of each rib 26 is tangential to an outer edge wall 22 of skirt 20.

Figure 2:
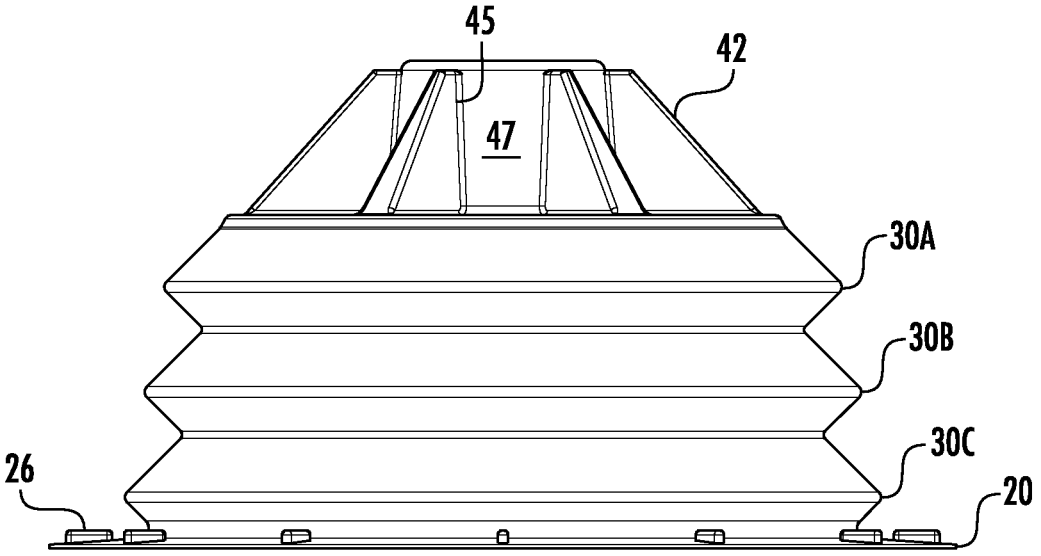
FIG. 2 is an edge view of the plunger seen in FIG. 1.

As best seen in reference to FIG. 2, an outer circumference of bellow 30*c* has a greater diameter than a diameter of the adjacent upper bellow 30*b*. A diameter of bellow 30*b* is greater than a diameter of the upper bellow 30*a*. Accordingly, the stacked orientation of bellows 30*a*, 30*b*, and 30*c* provides for a step wise increase in the diameter and size of each of the inner connected bellows.

Figure 3:
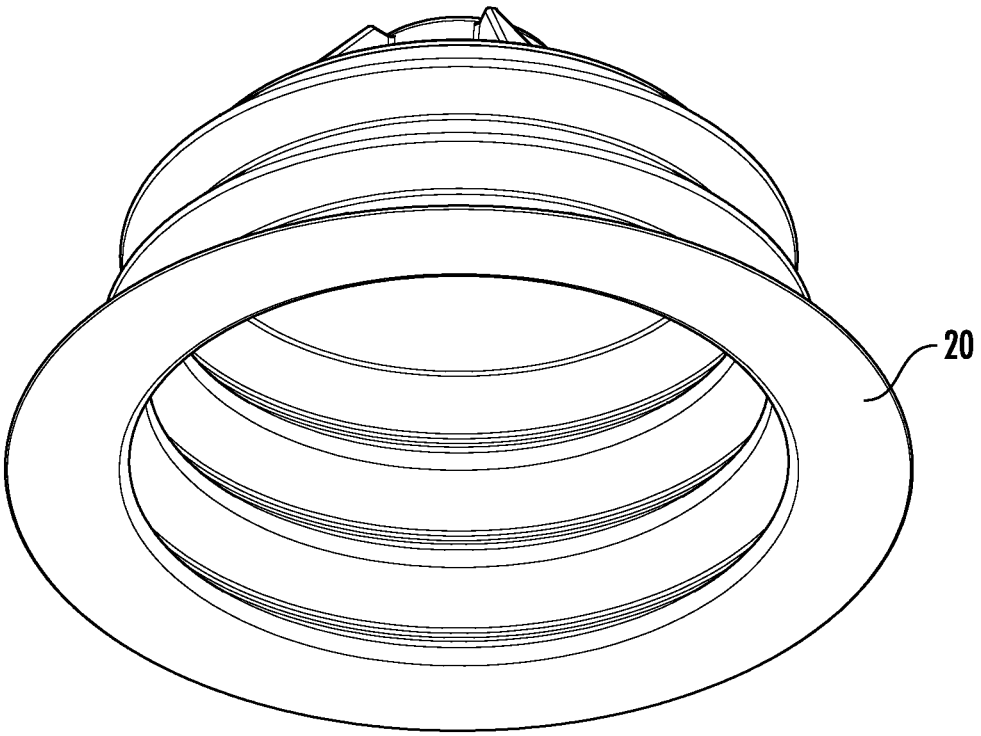
FIG. 3 is a perspective view bottom of the plunger seen in FIG. 1 showing details of the interior volume of the plunger.

As seen in reference to FIG. 3, an interior portion of the plunger that is defined by the bellows provides for a cavity and further defines a plunger volume.

Figure 4:
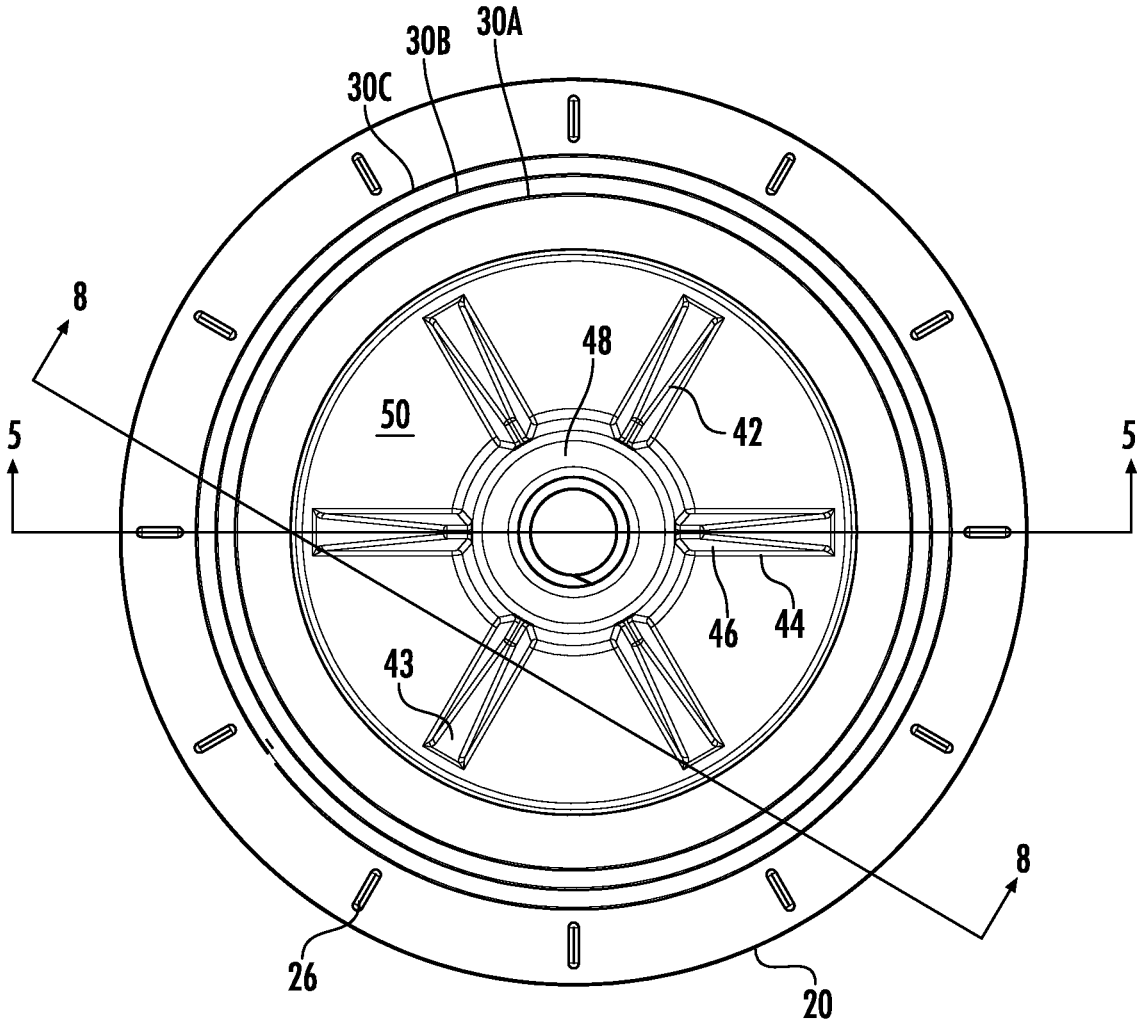
FIG. 4 is a top plan view of the plunger seen in FIG. 1.

As further seen in reference to FIG. 1 and FIG. 4, the plunger defines an upper bellow surface 50 which supports a handle receiving region 40. The handle receiving region 40 further defines a cylinder 48 having an outer cylindrical surface 47 and an inner cylindrical surface 49, surface 49 further defining a plurality of threads. A plurality of ribs 42 are attached along a vertical wall 45 to the outer cylindrical wall 47. Each rib 42 further defines a bottom wall 46 which is supported on an upper surface of the bellow top wall 50. Each rib 42 also defines an edge wall 43 which extends from an outer circular edge of the bellow top wall 50 to an upper edge of cylinder 48. As best seen in reference to FIG. 1, rib 42 also has a tapered thickness that increases from a top of the rib 42 to the bottom wall 46 of rib 42.

Figure 6:
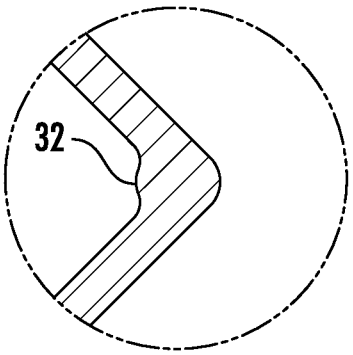
FIG. 6 is an enlarged portion of FIG. 5 showing additional detail of a reinforcement ridge.
Figure 7:
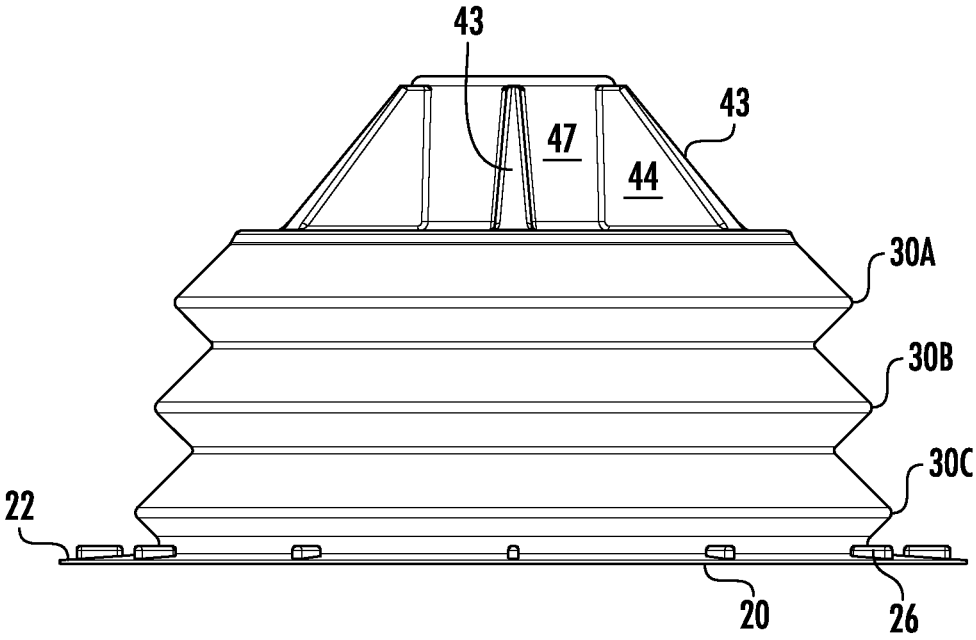
FIG. 7 is an enlarged view similar to FIG. 2 showing details of the plunger construction in greater clarity.
Figure 8:
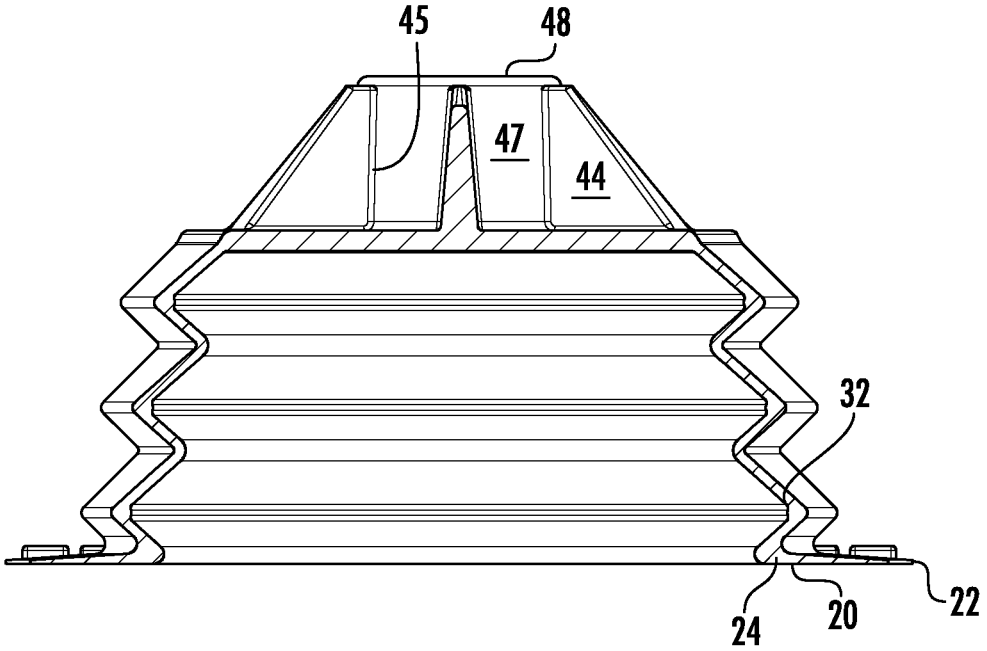
FIG. 8 is a sectional view taken along line 8-8 of FIG. 4.

As seen in reference to FIGS. 5 and 6, a mid section of each bellow 30*a*, 30*b*, and 30*c* defines an interior substantially right angle wall portion 32, wall portion 32 having a ridge of increased wall thickness in proximity to the right angle bend. As best seen in FIG. 6, in cross section the ridge 32 provides for an increased amount of material which increases the strength of the plunger, and facilitates the use of the plunger to provide a better negative pressure or vacuum by allowing the plunger to return to the normal uncompressed state.

The features described above offer an improvement to a plunger. The combination of features allow for a plunger that withstands collapsing, will readily return to an uncompressed state, provides for a more effective "no splash" seal relative to the toilet, and has a handle receiving area that provides for an improved distribution of forces and strength.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. A toilet plunger comprising:

a bottom skirt, skirt having a thickness at an outer circumferential edge less than a thickness of the skirt at an inner-circumferential edge, a lower skirt surface defining a plane which is perpendicular to a longitudinal axis of the plunger;

a plurality of at least three bellows, a first bellow secured to an upper surface of the skirt, wherein an upper surface of bottom skirt defines a plurality of rectangular ribs, each rib having an axis along its length that is tangential to the outer circumferential edge of the skirt, a second bellow position above and attached to the first bellow, and a third bellow, positioned above and attached to the second bellow, an interior space defined by the plurality of bellows defining a plunger volume;

a handle securing region positioned on top of the plurality of bellows and having a cylinder defining an inner cylinder surface having a plurality of threads adapted for receiving a handle and an outer cylinder wall;

a plurality of reinforcing ribs having a vertical wall attached to an outer cylinder wall, each reinforcing rib further defining a bottom wall supported on an upper surface of the bellow top wall, each reinforcing rib further defining an edge wall that extends from a circumferential edge of the bellow top wall to an upper edge of cylinder.

2. A toilet plunger according to claim 1 wherein the height from the bottom of skirt to the top the plurality of bellows is less than or equal to a diameter of an opening defined by skirt.

3. A toilet plunger according to claim 2 wherein the diameter of the bellows decreases from a bottom of the plunger to a top of the plunger.

4. A toilet plunger comprising:

a bottom skirt, skirt having a thickness and a outer circumferential edge less than the thickness of the skirt at an inner circumferential edge, a lower skirt surface defining an aperture therein;

a least one bellow secured to an upper surface of the skirt and defining therein an interior plunger volume, the interior plunger volume in communication with the bottom skirt aperture wherein the at least one bellow defining a substantially right angle mid-section wall, a portion of the mid-section wall defining a ridge of increased wall thickness in proximity to the right angle bend;

wherein a height from the bottom of skirt to the top of the at least one bellow is less than or equal to a diameter of the aperture defined by skirt.

5. The toilet plunger according to claim 1 wherein a diameter of the bellows decreases from a bottom of the plunger to a top of the plunger.

6. The toilet plunger according to claim 1 wherein each of the plurality of ribs has a tapered thickness that increases from a top of the rib to the bottom wall of rib.

* * * * *